US005625698A

United States Patent [19]

Barbetta

[11] Patent Number: 5,625,698

[45] Date of Patent: Apr. 29, 1997

[54] LOUDSPEAKER AND DESIGN METHODOLOGY

[76] Inventor: Anthony T. Barbetta, 5301 Commerce Ave. #4, Moorpark, Calif. 93021

[21] Appl. No.: 514,980

[22] Filed: Aug. 14, 1995

Related U.S. Application Data

[63] Continuation of Ser. No. 954,303, Sep. 29, 1992, abandoned.

[51] Int. Cl.[6] ..... H04R 3/00

[52] U.S. Cl. ..... 381/96; 381/59

[58] Field of Search ..... 381/59, 96

[56] References Cited

U.S. PATENT DOCUMENTS

| | | | |
|---|---|---|---|
| 3,889,060 | 6/1975 | Goto et al. | 381/96 |
| 4,406,921 | 9/1983 | Von Recklinghausen | 381/96 |
| 4,797,933 | 1/1989 | Hahne . | |
| 4,969,195 | 11/1990 | Noro . | |
| 5,014,320 | 5/1991 | Nagi et al. | 381/96 |
| 5,197,102 | 3/1993 | Sondermeyer | 381/96 |
| 5,408,533 | 4/1995 | Reiffin | 381/96 |

OTHER PUBLICATIONS

Scidmore, Allan K, "Linear Active Circuits Lecture Notes", University of Wisconsin, 1991.

Stahl, K.E., "Synthesis of Loudspeaker Mechanical Parameters by Electrical Means" *Audio Eng Soc*, vol. 29, No. 9, Sep. 1981.

*Primary Examiner*—Forester W. Isen

[57] ABSTRACT

The speaker system includes a speaker having first and second terminals. An audio amplifier is included having an output terminal connected to the first speaker terminal. A control loop is included which adjusts the level of a signal applied to the speaker in response to changes in the impedance thereof. The control loop includes a current sensing component connected between the second terminal of the speaker and ground. A differential input operational amplifier having first and second differential input terminals and an output terminal is included, the output terminal of which is connected to an input terminal of the amplifier. A first feedback path is provided, which includes a first resistor connected between the output terminal of the operational amplifier and the first input terminal thereof. A second feedback path is provided between the second terminal of the speaker and the second terminal of the operational amplifier. A load is connected between the inverting input terminal of the operational amplifier and ground.

9 Claims, 2 Drawing Sheets

LOUDSPEAKER AND DESIGN METHODOLOGY

This is a continuation of application Ser. No. 07/954.303 filed on Sep. 29, 1992, now abandoned.

BACKGROUND OF THE INVENTION

1. Field of the Invention:

The present invention relates to audio equipment. More specifically, the present invention relates to loudspeakers typically used in audio systems.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art:

Loudspeaker design is currently a mature art. For certain applications or tastes, an active speaker system may be preferred over a passive speaker system. Active speaker systems differ from passive systems in that active systems incorporate separately powered electronic circuits (i.e., power amplifiers and the like) for amplification and/or conditioning of signals applied thereto.

As active speaker systems are typically more expensive than passive speaker systems, the performance improvements must be evaluated in relation to the higher cost associated with the active speaker system. The designer of the active system is therefore challenged to design the speaker and the cabinet for optimal performance within certain design constraints. That is, an optimal design requires some interaction between the characteristics of the speaker, the power amplifier, and those of the cabinet and alignment values. For this purpose, the designer must assume either that the characteristics of a speaker are fixed and constant or vary within a limited range.

However, it is known that speaker characteristics actually change as a function of one or more parameters including age, power amplifier output impedance, operating temperature, materials of construction and etc. These parameters may vary independently or dependently further complicating design. For this reason, certain elements may be incorporated into the system to compensate, at least to a degree, for variations in the operating characteristics of speaker and cabinet alignment. These measures generally call for the use of compensation networks and the like.

One such network is an interface between the power amplifier and the speaker. The interface is a control loop with positive current feedback to generate a negative output impedance in the power amplifier. While these systems have been effective in allowing for the use of a large, high Q speaker in a small cabinet, this approach has been subject to some difficulties. Specifically, systems constructed with this approach tended to have a limited bandwidth and may oscillate at higher frequencies, Accordingly, this approach has been limited to use with sub-woofers.

Thus, a need exists in the art for an active speaker design and methodology therefor which would allow for the use of inexpensive components while providing improved performance over a wide bandwidth.

SUMMARY OF THE INVENTION

The need in the art is addressed by the present invention which provides a method of designing a speaker system. The inventive method includes the steps of a) providing a speaker with specifically selected characteristics normally available in the typical range of standard loudspeakers; b) connecting a circuit to the speaker to provide a speaker system with higher adjusted parameters over those of the raw speaker; c) calculating the quality rating of the speaker system; and d) designing a speaker cabinet based on the quality rating of the speaker system. In a particular implementation, the inventive method further includes the step of designing an amplifier control loop which provides a means of adjustment as if a variable resistor were connected in series with the speaker when the control loop is connected to the speaker.

DESCRIPTION OF THE INVENTION

Illustrative embodiments and exemplary applications will now be described with reference to the accompanying drawings to disclose the advantageous teachings of the present invention.

The advantageous design methodology of the present invention includes the step of selecting a loudspeaker with an extremely low quality rating (Q) which would normally yield a high 3 db point in the bass response.

Figure 1:
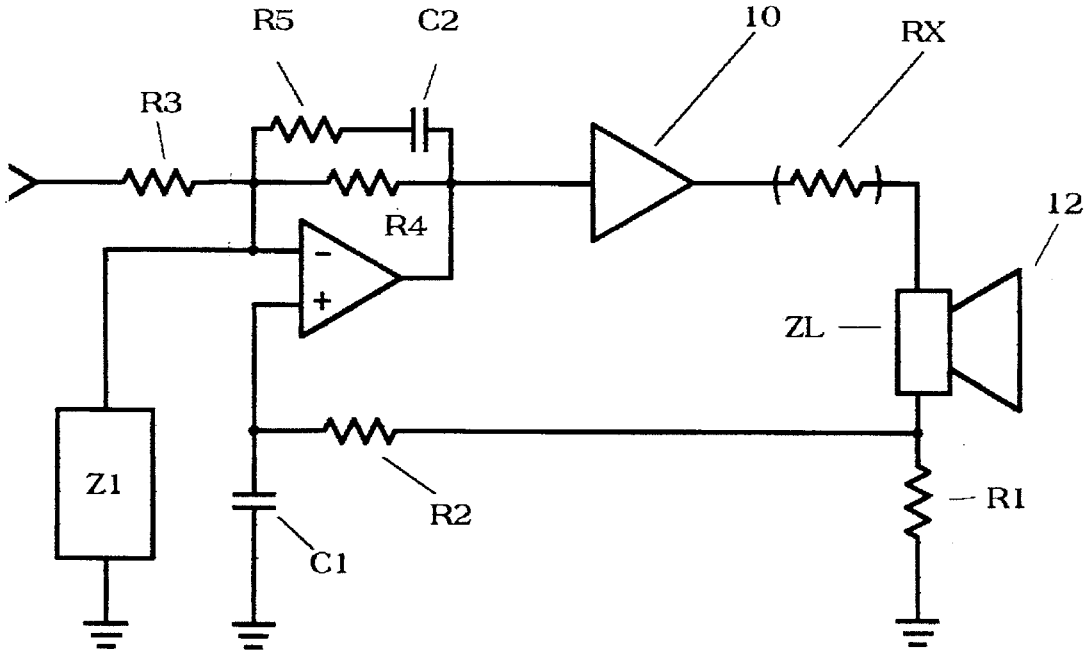
FIG. 1 is a first illustrative implementation of a control loop for varying the characteristics of a speaker in accordance with the teachings of the present invention.
Figure 2:
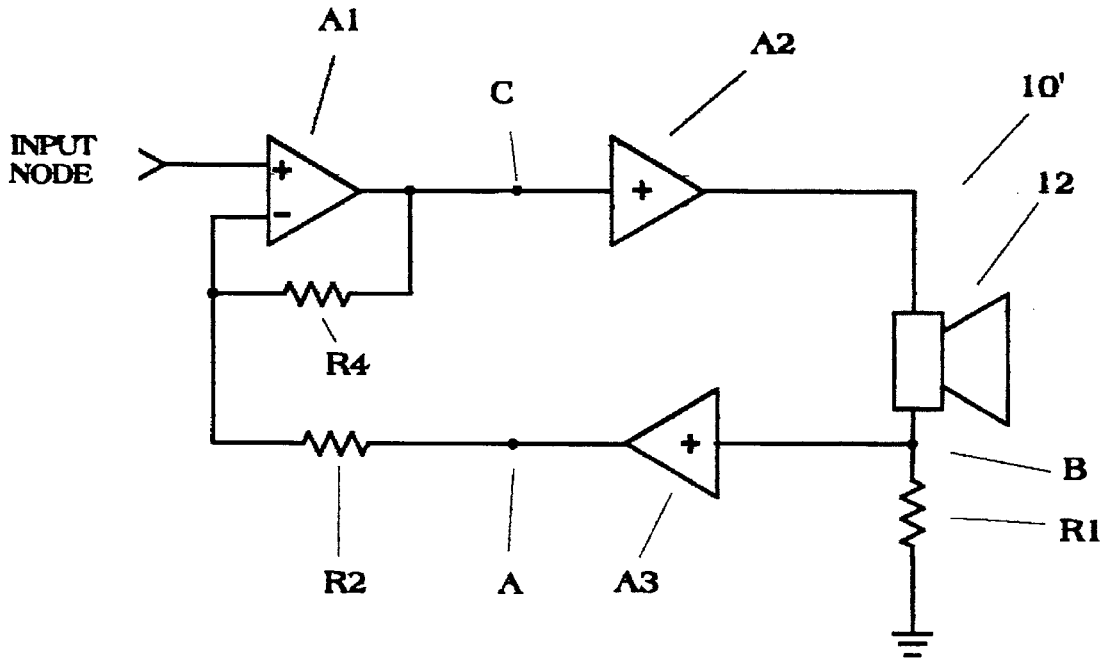
FIG. 2 is a second illustrative implementation of a control loop for varying the characteristics of a speaker in accordance with the teachings of the present invention.
Figure 3:
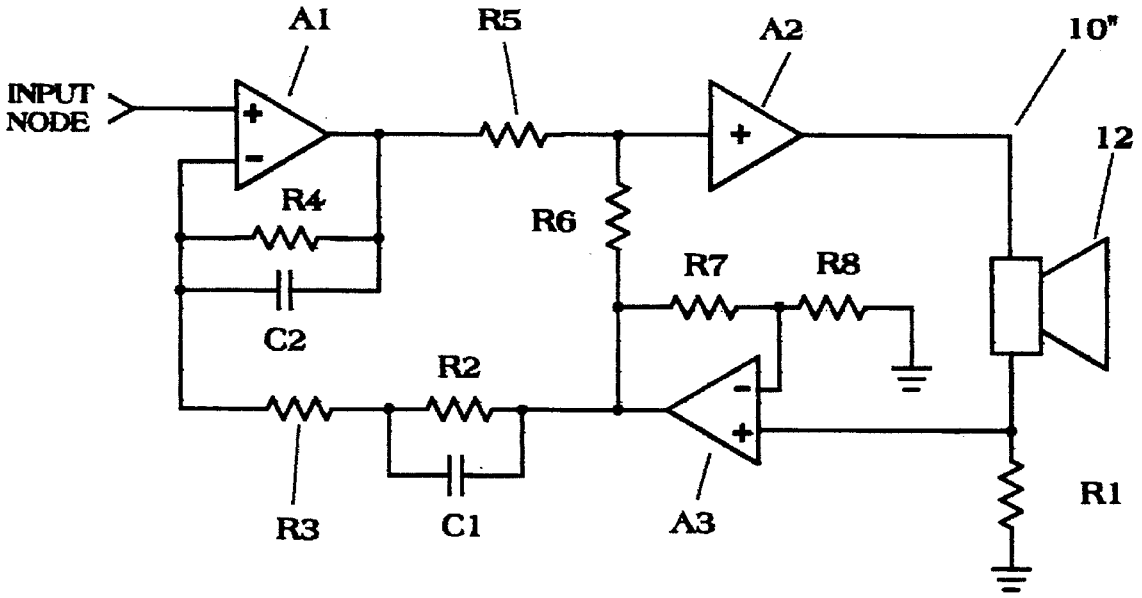
FIG. 3 is a third illustrative implementation of a control loop for varying the characteristics of a speaker in accordance with the teachings of the present invention.

Next, an electrical control loop is added to the speaker to increase the Q thereof. In accordance with the present teachings, this is accomplished by an amplifier circuit that senses the impedance of the speaker (by sensing the current therethrough) and by simulating a resistive element in series with the speaker. FIGS. 1–3 show alternative illustrative implementations of control loops for increasing the Q of the speaker in accordance with the present teachings.

In the first implementation of FIG. 1, the inventive circuit 10 is shown with a low Q speaker 12 having an impedance $Z_L$. The control loop includes first and second amplifiers $A_1$ and $A_2$, respectively. The first amplifier $A_1$ has differential input terminals and an RC feedback loop connected between the output terminal and the negative input terminal thereof. The feedback circuit includes a resistor R4 in parallel with a series combination of a resistor R5 and a capacitor C2. Input to the circuit 10 is provided through a resistor R3 connected between an input terminal and the negative input of the first amplifier $A_1$.

The output of the first amplifier $A_1$ is connected to the input of the second amplifier $A_2$. The second amplifier is a conventional audio power amplifier. The output of the second amplifier $A_2$ is connected to one terminal of the speaker 12. The resistor $R_x$ is not physically present but merely simulated by the operation of the present invention. This allows for the advantageous operation of the present invention without the power loss that would be associated with an actual resistor in this location.

A second connection to the speaker 12 is made to ground through a sensing resistor R1 which is on the order of 0.1 ohms in resistance. A resistor R2 is connected between the second terminal of the speaker and the positive input terminal of the first amplifier $A_1$. A capacitor C1 is connected between the positive input terminal of the first amplifier $A_1$ and ground to provide for high frequency compensation and control. A load $Z_1$ is connected between the inverting terminal of the first amplifier $A_1$ and ground. The load $Z_1$ may be used to adjust the gain of the first amplifier $A_1$ for the feedback signal for higher Q speakers. The load $Z_1$ may be a frequency dependent component for response shaping.

In operation, current through the speaker 12 is sensed by the resistor R1 which supplies a voltage in response thereto. This voltage is filtered by the filter consisting of R2 and C1 and input to the positive terminal of the first amplifier $A_1$. R2 and C1 form a simple lowpass ground referenced filter which sets the dominant pole of the control loop and provide stability for same. R3 and R4 establish the gain applied to the input signal. The voltage fed back to the positive port of the first amplifier $A_1$ reduces the gain of the input signal applied through the resistor R3. R4 and R5 control the gain applied to the signals appearing at the positive port of the first amplifier independently of the gain applied to the input signal. Thus, one skilled in the art will appreciated that the control loop acts as a constant power circuit which adjusts the voltage applied to the speaker as the impedance thereof changes.

Although $R_x$ is not an actual component, the gain of the first amplifier $A_1$ is adjusted so that the voltage across the loudspeaker is modulated as though $R_x$ were actually present. The next step in the advantageous method then is to calculate what the Q of the speaker would be if $R_x$ were actually present in accordance with the following relation:

$$Q_E'=Q_E(R_E+R_x)/R_E \quad [1]$$

where $Q_E'$ is the new quality rating of the system;

$Q_E$ is the original quality rating of the speaker;

$R_E$ is the DC resistance of the voice coil of the speaker; and $R_x$ is the DC resistance of other elements in the system outside of the circuit 10 including the crossover network, speaker wire and the output impedance of the power amplifier $A_2$. In the invention, apparent amplifier output impedance is adjustable through the control loop.

Thus, rather than minimizing these constituent effects of $R_x$ as is common with conventional teachings, in accordance with the present teachings, these effects are used to create a controlled increase in the quality rating of the speaker system above that of the speaker itself. That is, the control loop simulates and controls a the resistance $R_x$ needed to align the speaker and cabinet. This allows the speaker to be used in a cabinet that will produce a lower bandwidth than otherwise possible with minimum sacrifice in overall efficiency.

Next, the new higher quality rating characteristics of the speaker are calculated in accordance with equation [2].

$$Q_T'=(Q_M+Q_E')/Q_MQ_E' \quad [2]$$

where $Q_T$ is the new quality rating and $Q_M$ is mechanical Q.

Next, the speaker cabinet is designed for the speaker with the higher quality rating $Q_T'$ in a conventional manner using formulas as is well known in the art. The following design methodology is illustrative. Let $h=(0.420/Q_T)^{0.953}$, $\alpha=(0.0569/Q_T)^{3.153}$ and $f_3/f_s=(0.305/Q_T)^{1.33}$; where h=cabinet resonant frequency relative to $f_3$, $\alpha$=loudspeaker acoustic compliance divided by cabinet volume, $f_3$=−3 db point of loudspeaker and cabinet, and $f_s$=resonant frequency of loudspeaker. All values are for small alignments with $Q_L$=7.

Finally the gain of the first amplifier $A_1$ is dynamically adjusted to simulate the presence of $R_x$ for the complete system as described above.

FIG. 2 is a second illustrative implementation of a control loop for increasing the Q of a speaker in accordance with the teachings of the present invention. In this embodiment, the first amplifier $A_1$ will adjust its output so that each of its inputs will be at the same voltage level. The current sensed by the resistor R1 is converted to a voltage which is buffered and amplified by a third amplifier $A_3$. The system 10' is designed so that at a particular impedance level for the speaker 12, the voltage at node A will be the same as that at the input node. Thus, node A is the control node. As the impedance of the speaker varies, the voltage applied to the control terminal of the first amplifier $A_1$ changes and its output changes accordingly. This signals the power amplifier to change its output as well. Thus, changes in impedance are used to adjust the power applied to the speaker 12.

FIG. 3 is a third illustrative implementation of a control loop for increasing the Q of a speaker in accordance with the teachings of the present invention. This embodiment has a negative output impedance. This circuit raises the $Q_T$ because of $R_5$ and $R_6$. $R_2$, $R_3$ and $C_1$ are used to neutralize the negative output impedance at higher frequencies.

Thus, the present invention has been described herein with reference to a particular embodiment for a particular application. By selecting loudspeaker parameters, a broadband system is possible as opposed to a woofer or subwoofer only. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A speaker system comprising:

a speaker having first and second terminals:

an audio amplifier having an output terminal connected to said first speaker terminal;

current sensing means connected between the second terminal of said speaker and ground;

a differential input operational amplifier having a first inverting input terminal and a second non-innverting input terminal and an output terminal, said first inverting input terminal being an input terminal of said speaker system and said output terminal being connected to an input terminal of said audio amplifier, said differential input operational amplifier providing a first gain to a signal applied to said first inverting input terminal and a second gain to a second signal applied to said second non-inverting input terminal;

a first feedback path defining a voltage loop, including a first resistor, being connected between the output terminal of said operational amplifier and the first inverting input terminal thereof;

a second feedback path being connected between the second terminal of said speaker and the second non-inverting terminal of said operational amplifier; and load means of selected value connected between said first inverting input terminal of said operational amplifier and ground.

2. The invention of claim 1 wherein said second feedback path includes a second resistor.

3. The invention of claim 2 including a first capacitor connected between said second terminal of said differential input operational amp and ground.

4. The invention of claim 1 wherein said load is a resistive load.

5. The invention of claim 1 wherein said load is a frequency dependent load.

6. The invention of claim 1 including a resistor connected between a circuit input terminal and said first terminal of said operational amplifier.

7. The invention of claim 6 wherein said current sensing means is a resistor.

8. A speaker system comprising:

a speaker having first and second terminals;

an audio amplifier having an output terminal connected to said first speaker terminal;

current sensing means including a resistor connected between the second terminal of said speaker and ground;

a differential input operational amplifier having first and second differential input terminals and an output terminal, said first terminal of said operational amplifier being the inverting terminal thereof and said output terminal being connected to an input terminal of said amplifier, said differential input operational amplifier providing a first gain to a signal applied to said first input terminal and a second gain to a second signal applied to said second input terminal;

a first feedback path, including a first resistor, being connected between the output terminal of said operational amplifier and the first input terminal thereof, said first feedback path including a second resistor connected in series with a first capacitor and said second resistor and said first capacitor being connected in parallel with said first resistor;

a second feedback path including a third resistor connected between the second terminal of said speaker and the second terminal of said operational amplifier and a second capacitor connected between said second terminal and ground; and load means of selected value connected between said first inverting input terminal of said operational amplifier and ground.

9. The invention of claim 8 including a fourth resistor connected between a circuit input terminal and said first terminal of said operational amplifier.

* * * * *